US009404245B2

(12) United States Patent
Lagger

(10) Patent No.: US 9,404,245 B2
(45) Date of Patent: Aug. 2, 2016

(54) SINK PLUNGER ASSIST

(71) Applicant: John Lagger, Joliet, IL (US)

(72) Inventor: John Lagger, Joliet, IL (US)

( * ) Notice: Subject to any disclaimer, the term of this patent is extended or adjusted under 35 U.S.C. 154(b) by 0 days.

(21) Appl. No.: 14/793,873

(22) Filed: Jul. 8, 2015

(65) Prior Publication Data

US 2016/0069055 A1 Mar. 10, 2016

Related U.S. Application Data

(60) Provisional application No. 62/047,164, filed on Sep. 8, 2014.

(51) Int. Cl.
*E03D 11/00* (2006.01)
*E03C 1/308* (2006.01)
*A47K 17/00* (2006.01)

(52) U.S. Cl.
CPC ..... *E03C 1/308* (2013.01); *A47K 17/00* (2013.01)

(58) Field of Classification Search
CPC ..... E03C 1/304; E03C 1/308
USPC ..... 4/255.01, 255.05, 244.07, 255.11, 4/255.12
See application file for complete search history.

(56) References Cited

U.S. PATENT DOCUMENTS

| | | | | |
|---|---|---|---|---|
| 1,240,132 | A * | 9/1917 | Gleason | E03C 1/306 285/18 |
| 6,058,525 | A | 5/2000 | Paden | |
| 6,687,926 | B1 | 2/2004 | Bayley | |
| 6,915,533 | B1 * | 7/2005 | Gorobets | E03C 1/308 4/255.11 |
| 8,166,584 | B2 | 5/2012 | Ball | |
| 8,250,679 | B1 * | 8/2012 | Farina | E03C 1/306 4/255.05 |
| 8,266,735 | B2 | 9/2012 | McLeod | |
| 8,505,132 | B2 | 8/2013 | Ball | |

* cited by examiner

*Primary Examiner* — Huyen Le
(74) *Attorney, Agent, or Firm* — Daniel Boudwin; Global Intellectual Property Agency

(57) ABSTRACT

An apparatus for effectively plunging a drain by blocking the redirection of water is provided. The apparatus includes a pipe mainframe defining an enclosed area. The pipe mainframe includes a plurality of piping having a front portion and a rear portion. Tee pipes are outwardly disposed on the front portion and the rear portion of the pipe mainframe. The rear portion includes an adjustable connector attached to the outward end of the tee pipe. The adjustable connector can modify the length of the pipe mainframe to accommodate sinks or basins of various lengths. The apparatus further includes a rubber pipe cap at a distal end of the front portion of the pipe mainframe to effectively block the flow of water and provide support for the device.

12 Claims, 4 Drawing Sheets

SINK PLUNGER ASSIST

CROSS REFERENCE TO RELATED APPLICATION

Figure 1:
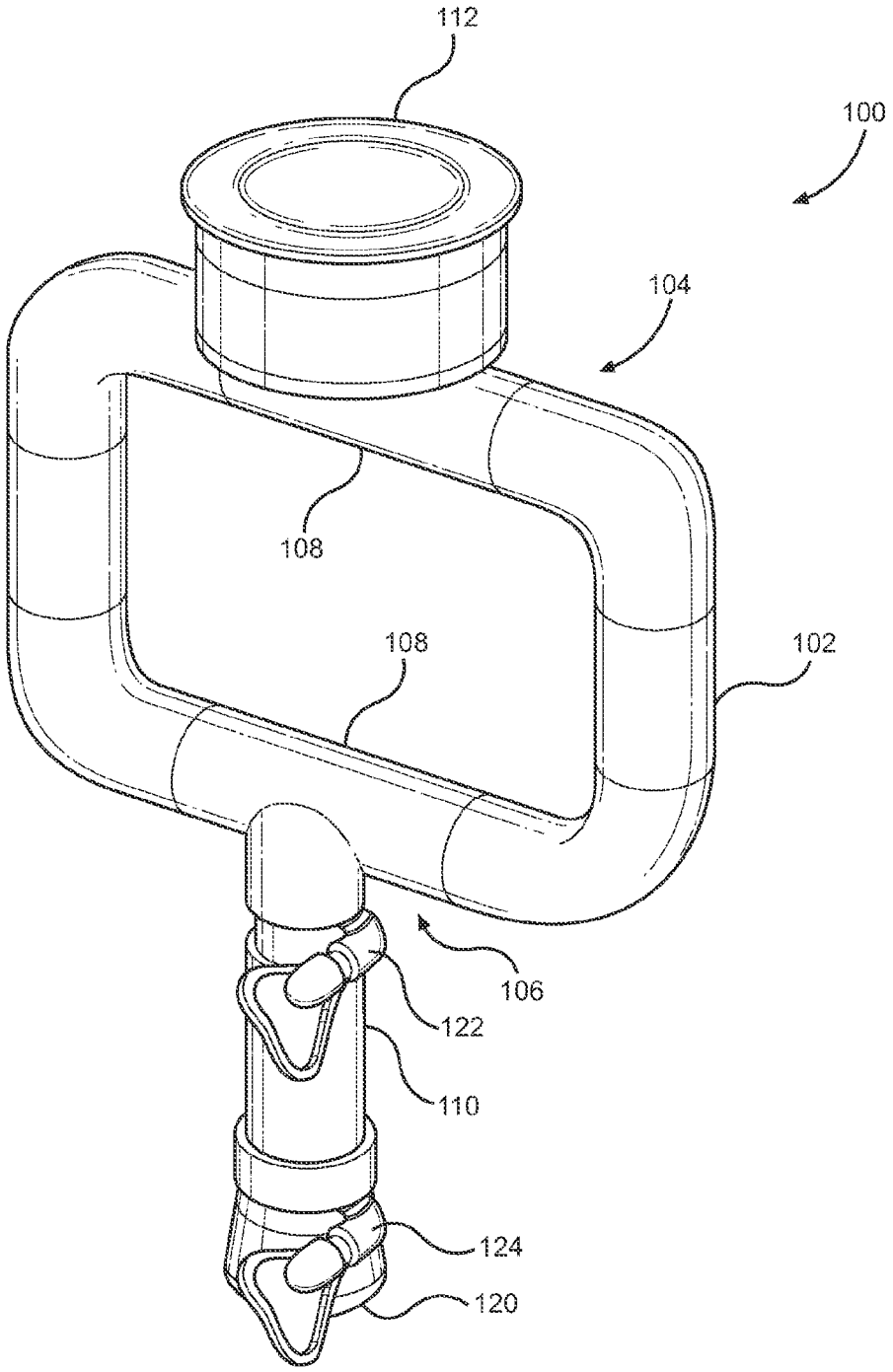

This application claims the benefit of U.S. Provisional Application No. 62/047,164 filed on Sep. 8, 2014. The above identified patent application is herein incorporated by reference in its entirety to provide continuity of disclosure.

FIELD OF THE INVENTION

The present invention relates to an apparatus for sink drainage, and more particularly to an apparatus for preventing overflow of water into a sink or basin while plunging a drain. The framework of pipes and fittings block run-off holes and allows a plunger to be inserted therein, preventing any backflush into a sink basin while the drain is being plunged.

BACKGROUND OF THE INVENTION

Garbage disposals and kitchen sink drains can become contaminated with waste water, resulting in unpleasant odors that disseminate throughout the household. Slow draining sinks and washbasins add to these problems and affect the lives of many people, often resulting in remodeling or other costly repairs. People assume that many sources, including clogs and venting problems, cause the slow draining and spend money needlessly trying to correct the problem. Slow drainage makes keeping the sink clean much more difficult by preventing a user from rinsing the sink clean after use.

Particularly, sink drainage of waste water can move extremely slowly or quickly come to a halt. This happens because waste water pools in the bottom of the sink, which provides a location where bacteria and viruses can accumulate and multiply over time. Many contaminates can linger and infest sink drainage systems such as the buildup of hair, grease, minerals and soap scum. Additionally, odors from the sink can become more pronounced, wafting throughout the entire household. Therefore, a device is needed for clearing slow-running or stagnant water in a sink.

At the present time, there are many types of water overflows for sinks, basins and most, if not all, have a disadvantage in that they are not completely sanitary and the openings for the overflow are situated in locations which are inaccessible for cleaning purposes, particularly in respect to the interiors thereof. In most instances, the overflow is formed in the sink or basin itself, providing an opening at the upper portion of the basin for the discharge of the liquid down into the drain. The space behind the opening is likely to become contaminated and unsanitary, and it is difficult, if not impossible to clean.

Additionally, in newly constructed plumbing systems, it is desired to cap all drains with a stopper. The drains include the waste drain and overflow drains of bathtubs, sinks, washbasins, etc. The drains are capped for a variety of reasons, but two major reasons are to prevent waste material generated by construction from entering the drains and, secondly, to allow pressure testing of the plumbing system. The pressure test is typically required during a building department inspection.

Devices are known that relate to overflow assemblies for sinks and bathtubs. Some devices provide an overflow device assembly for a vessel such as a bathtub or sink, comprising a faceplate and a mating flange. Other devices provide multipiece waste and overflow units that can be utilized with a bathtub in order to remove waste water via the overflow drain hole. These devices however, do not utilize an adjustable bathroom sink insert comprising pipes, fixtures and rubber caps, wherein the device can be inserted into a sink to block the overflow drain hole, thereby allowing a user to insert a plunger therein.

SUMMARY OF THE INVENTION

In view of the foregoing disadvantages inherent in the known types of sink overflow assemblies now present in the prior art, the present invention provides a sink plunging device wherein the same can be utilized for providing convenience for the user when plunging a sink.

It is therefore an object of the present invention to provide a new and improved sink plunging device for effectively dispelling stagnant water from a drainage system that has all of the advantages of the prior art and none of the disadvantages.

Therefore, it is an object of the present invention to provide an apparatus for effectively plunging a sink or basin. The apparatus includes a pipe mainframe defining an enclosed area, tee pipes, an adjustable connector and rubber caps. The pipe mainframe includes a plurality of piping having a front portion and a rear portion. The pipe mainframe is configured to receive a sink plunger in the enclosed area defined by the pipe mainframe. The pipe mainframe is composed primarily of Chlorinated Polyvinyl Chloride CPVC piping and fittings or other suitable materials.

It is another object of the present invention to provide a pipe mainframe with tee pipes disposed outwardly from the front portion and the rear portion of the pipe mainframe. The tees comprise T-shaped pipes disposed outwardly from the front portion and the rear portion.

It is yet another object of the present invention to provide an apparatus having an adjustable connector attached to an outward end of the tee pipe located at the rear portion. The adjustable connector can modify the length of the pipe mainframe to accommodate sinks of various lengths. The adjustable connector includes telescopic connector pipes that are secured in placed via a fastener to adjust a length of the pipe mainframe. The sink or basin lengths can be marked by butterfly clamps located on the adjustable connector and the pipes may be secured in place using a lever clamp.

Another object of the present invention is to provide an apparatus having a rubber cap at the distal end of the adjustable connector. Additionally, a rubber pipe cap is located at the distal end of the tee pipe at the front portion of the pipe mainframe. The rubber pipe cap inhibits back flush of water into the basin while a plunger is applying pressure to clogs in stagnant drains.

It is an object of the present invention to provide an apparatus for effectively plunging a sink wherein the pipe encloses a square area. The square area formed by the pipe mainframe allows a plunger to fit therein.

It is yet another object of the present invention to provide an apparatus for effectively plunging a sink wherein the pipe mainframe comprise plastic piping with 90° elbows defining a square or rectangular aperture.

Another object of the present invention is to provide an apparatus for effectively plunging a sink wherein the connector pipes are T-shaped pipes disposed outwardly from the front portion and the back portion.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 shows a perspective view of the apparatus for effectively plunging a sink according to one embodiment of the present invention.

Figure 2:
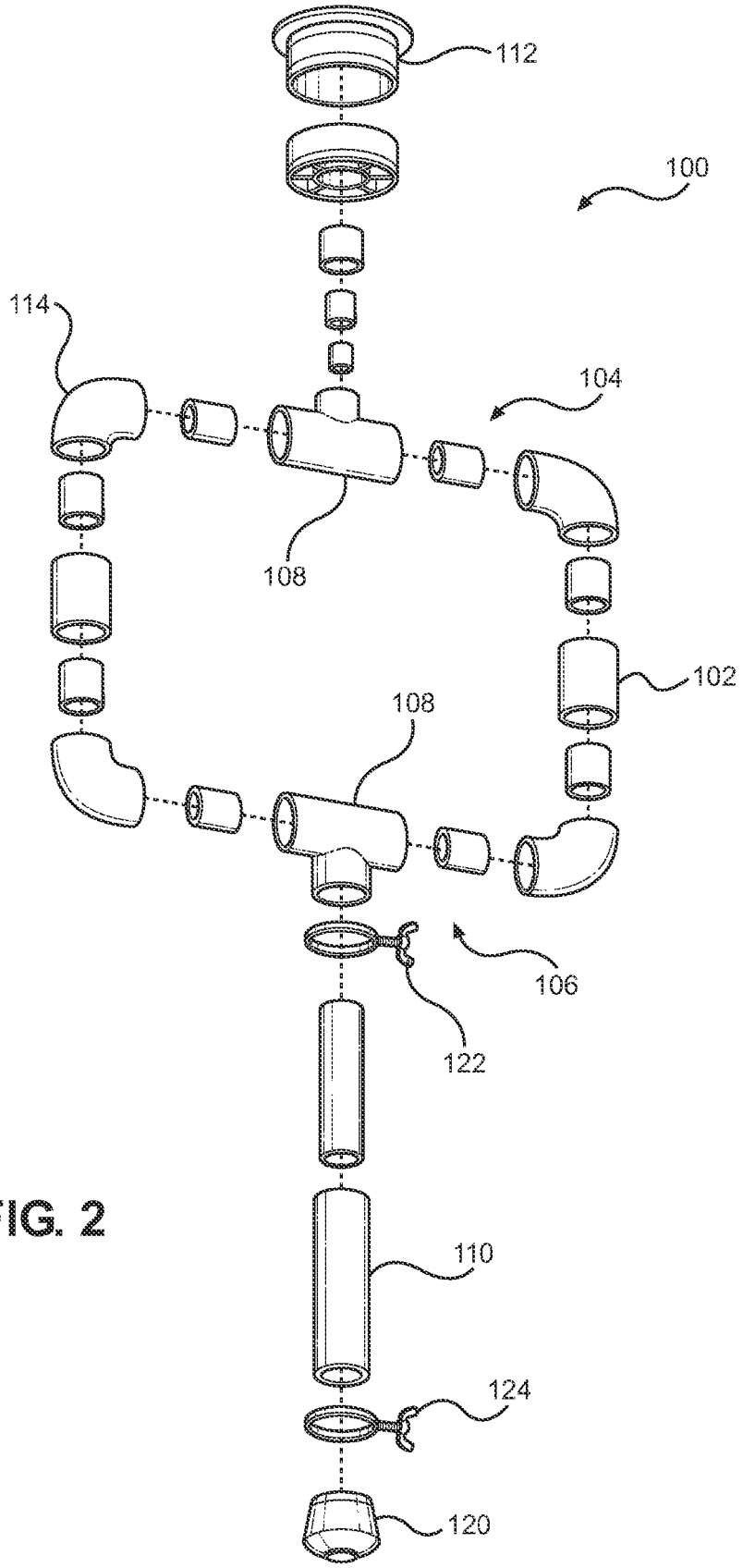
Figure 3A:
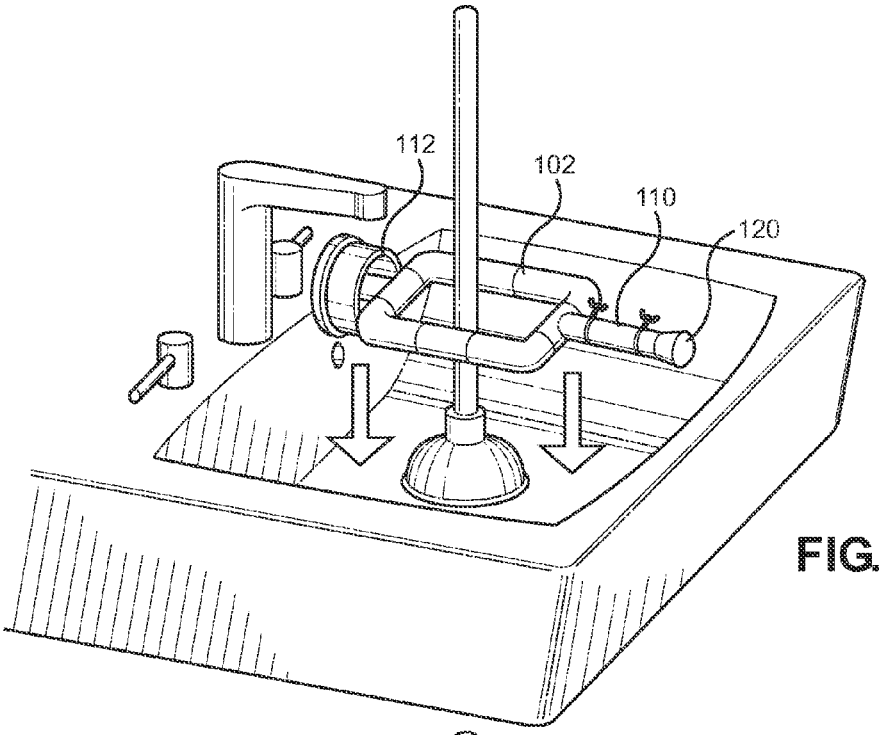
Figure 3B:
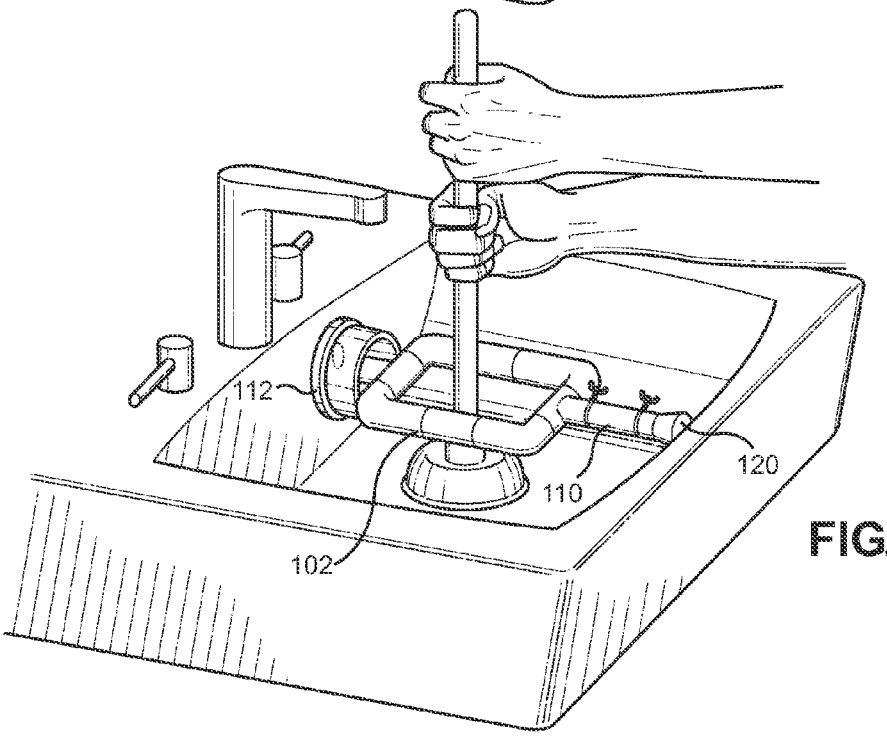
Figure 4A:
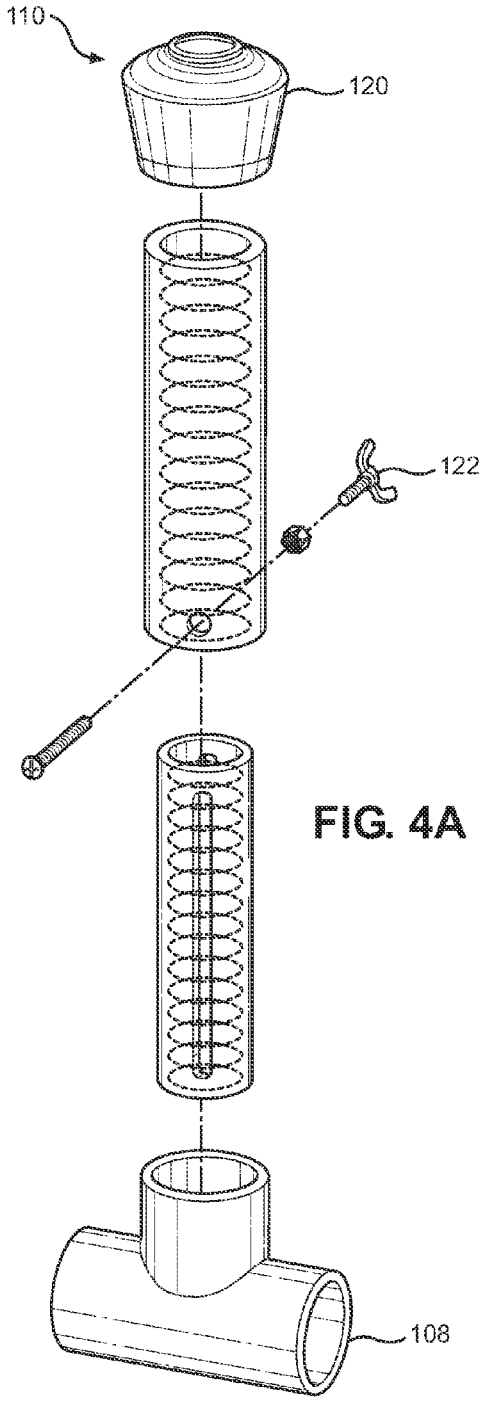
Figure 4B:
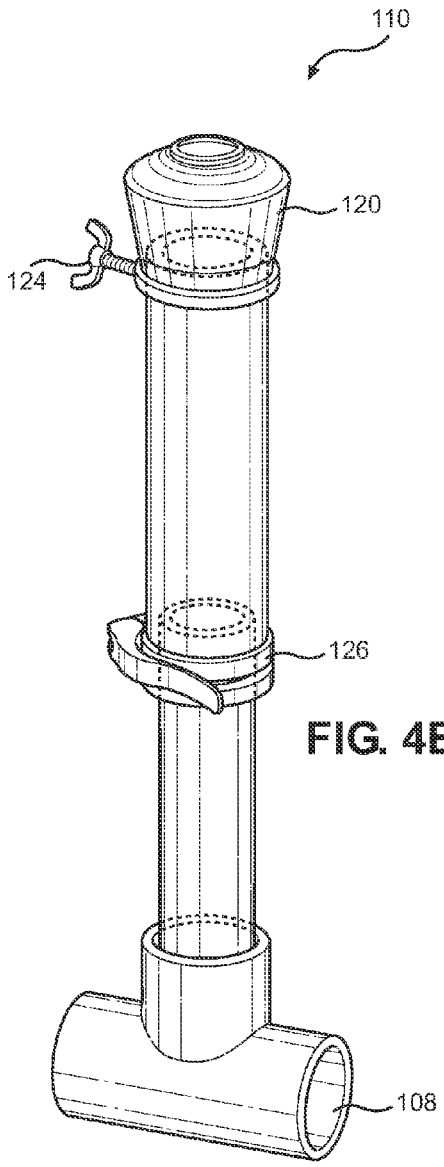

FIG. 2 shows an exploded view of the apparatus for effectively plunging a sink in accordance with one embodiment of the present invention FIGS. 3A and 3B show perspective views of the apparatus for effectively plunging a sink fitted inside a sink basin and plunger therein in accordance with one embodiment of the present invention FIGS. 4A and 4B show the adjustable connector pipe in accordance with multiple embodiments of the present invention.

DETAILED DESCRIPTION OF THE INVENTION

Reference is made herein to the attached drawings. Like reference numerals are used throughout the drawings to depict like or similar elements of the apparatus for effectively plunging a sink. For the purposes of presenting a brief and clear description of the present invention, the preferred embodiment will be discussed as used for sinks and wash basins. The figures are intended for representative purposes only and should not be considered to be limiting in any respect.

Referring now to FIGS. 1 and 2, there are perspective views of the apparatus for effectively plunging a sink according to multiple embodiments of the present invention. The apparatus 100 according to the present embodiment comprises a pipe mainframe 102, tee pipes 108 on opposing ends of the pipe mainframe 102, an adjustable connector 110, and a rubber pipe cap 112. The apparatus 100 for effectively plunging a sink is a tool intended for use primarily in pedestal bathroom sinks that have run-off holes at the rear of the basin. The run-off holes prevent overflow of water within the basin. The apparatus 100 applies an appropriate amount of pressure against run-off holes to prevent a back flow of water into the basin while the sink drain is being plunged. The run-off holes are blocked by a rubber pipe cap 112.

The pipe mainframe 102 is preferably configured to form a loop so as to define a central area. In the illustrated embodiment, the pipe mainframe 102 comprises a square configuration, however in alternate embodiments the pipe mainframe may comprise a plurality of shapes that allow a plunger to fit there-through. The pipe mainframe 102 includes a front portion 104 and a back portion 106 at opposite ends of the pipe mainframe 102. In one embodiment the pipe mainframe 102 comprises 0.5 inch plastic piping with 90° elbows defining a square aperture. The central area enclosed by the pipe mainframe 102 is provided so that a plunger can be inserted there-through. It is contemplated that the pipe mainframe 102 may have different configurations including, but not limited to, a rectangular area or circular area, among others. It is preferred that the pipe mainframe 102 defines a square shaped area to allow a sink plunger therein. The pipe mainframe 102 and the fittings for the pipes are preferably comprised of chlorinated polyvinyl chloride ("CPVC").

According to one embodiment of the present invention, the pipe mainframe 102 comprises 17 individual CPVC piping and fittings. The pipe mainframe 102 includes at least four elbows 114, two couplings, two tees, and six lengths of ¾ inch pipe. The pipe mainframe further includes a ½ inch length of pipe and two lengths of ¾ inch pipe, for a total of 17 pieces that comprise the pipe mainframe 102. The CPVC piping and fittings are manufactured by GENOVA®, LASCO® and CHARLOTTE®. It is contemplated that the lengths of fittings may vary slightly, therefore it is preferred to use the correct fitting manufacturer for the parts to get accurate measurements.

In one embodiment of the present invention, the pipe mainframe 102 may comprise 17 different pipes and fittings. The 17 parts and pieces are as follows:

6→¾ inch CPVC pipes in 1⅜ inch lengths;
2→¾ inch CPVC pipes in 1½ inch lengths;
4→¾ inch CPVC 90° elbows;
2→¾ inch CPVC couplings;
1→¾ inch CPVC tee;
1→¾ inch by ¾ inch by ½ inch CPVC tee and
1 pipe→½ inch CPVC pipe in 3 inch length;

A ½ inch nozzle on the ¾ inch by ¾ inch by ½ inch CPVC tee may be used with the 3 inch length of ½ inch CPVC pipe to connect the pipe mainframe 102 to the rubber cap 112 via the ½ inch CPVC coupling. In a preferred embodiment, the ½ inch nozzle is drilled or sanded to allow the 3 inch length of ½ inch CPVC pipe to slide firmly to the rear of the front tee.

In one embodiment, the construction of pipe mainframe 102 forms a square aperture. Four 90° elbows are placed in a six inch square position, with one elbow at each corner. Along both sides of the pipe mainframe are couplings. In the front 104 portion of the pipe mainframe 102, between the elbows, is a ¾ inch by ¾ inch by ½ inch CPVC tee facing outward. In the back portion 106 of the pipe mainframe 102 is a ¾ inch CPVC tee facing outward.

The 3 inch length of ½ inch CPVC pipe is placed through a sanded front nozzle of the tee. The two lengths of ¾ inch CPVC pipes in 1½ inch lengths are placed into the sides of the tee at the back portion 106 of the pipe mainframe 102. The remaining 6 lengths of ¾ inch CPVC pipes in 1⅜ inch lengths hold together the junctions of elbows, couplings, and front tee by placing the pipes horizontally through each ¾ inch side opening. The ¾ inch CPVC pipes will disappear as pressure is applied at each junction. This will form a smooth, strong square pipe mainframe 102 having an opening at the center for the plunger handle. Some embodiments may also form a rectangular pipe mainframe 102.

The adjustable connector pipe 110 is coupled to the outwardly disposed tee pipe 108 at the back portion 106 of the pipe mainframe 102. The outward end of the adjustable connector pipe 110 includes a rubber cap 120 at a distal end of the adjustable connector pipe 110 which engages the surface of a sink basin by applying pressure. The adjustable connector pipe 110 length may be adjusted via telescopic piping to accommodate sinks or wash basins of different sizes and shapes.

The adjustable connector 110 is attached to the outward end of the tee pipe 108 at the back portion 106. The adjustable connector 110 is configured to modify the length of the pipe mainframe 102 via telescopic piping which can be secured at desired length via a fastener, such as a clamp. In one embodiment, the telescopic piping of the adjustable connector 110 comprises a ¾ inch pipe and a 1 inch pipe that pass through and over each other smoothly and firmly. The adjustable connector 110 further includes a first butterfly clamp 122 and a second butterfly clamp 124. The first butterfly clamp 122 defines the length of the adjustable connector 110. The second butterfly clamp 124 is located at the base of rubber cap 120.

The apparatus further includes a rubber pipe cap 112 at a distal end of the tee pipe 108 at the front portion 104 of the pipe mainframe 102. The adjustable connector pipe 110 is adjusted until the rubber pipe cap 112 is flush against a run-off hole of a sink or basin. When the rubber pipe cap 112 on the front portion 104 and the rubber cap 120 on the back portion 106 are engaged with opposite ends of the sink surface, the apparatus 100 is suspended above the sink base. The adjustable connector pipe 110 is adjusted to a length that allows the rubber pipe cap 112 to be flush against a surface. The rubber pipe cap 112 comprises three plastic fittings inserted within the rubber pipe cap 112. It is preferred that rubber caps are sized so as to completely block run-off holes. The rubber pipe cap 112 is held firmly in place by a frame of plastic bushings, pipes and fittings. The pipe and fitting framework provides for a square opening over the drain that allows for a plunger placed over the drain with the handle protruding upward through the pipe framework.

According to one embodiment, a 2.75 inch diameter rubber pipe cap 112 is disposed on the front portion 104 of the pipe mainframe 102 and has an inside diameter of 2 inches and may be manufactured by FERNCO®. The rubber cap may include two reducing PVC bushings. Within the rubber pipe cap 112 is a 2 inch by ¾ inch reducing PVC bushing cut to a thickness of ¾ inches. Within the ¾ inch opening of the larger bushing is a MUELLER® ¾ inch by ½ inch reducing PVC bushing cut to a thickness of ¾ inches. Within the ¾ inch by ½ inch reducing PVC bushing is a ½ inch CPVC coupling cut to ¾ inches. All four parts of the rubber pipe cap 112 fit securely in a unit that efficiently blocks the back flow of water through the run-off holes preventing the water from entering the basin from the pressure of the plunger. This allows the pressure from the plunger to be completely directed towards removing the clog from the sink.

Referring now to FIGS. 3A and 3B, there are shown perspective views of the apparatus for effectively plunging a sink fitted inside a sink basin and plunger therein in accordance with embodiments of the present invention. The pipe mainframe 102 is placed in a sink or basin with a plunger therein. The pipe mainframe 102 is preferably arranged in a substantially horizontal orientation, wherein the central area defined by the pipe mainframe is vertically aligned with the drain of the sink. In this way, the user can place the plunger over the sink drain, and the handle of the plunger can extend upward and through the central area of the pipe mainframe, such that the pipe mainframe covers the runoff hole without interfering with the user's ability to plunge the sink drain. The pipe mainframe 102 provides an area that allows for a plunger to fit therein. The rubber pipe cap 112 is placed over the run-off hole of a sink and rests flush against the opening of the run-off hole to prevent backflow of water. The length of the pipe mainframe 102 is adjusted via the adjustable connector 110. The adjustable connector 110 is extended to a length that allows the pipe mainframe 102 to fit snugly in the sink. The rubber cap 120 contacts an portion of the sink basin opposite the run-off hole and allows the pipe mainframe 102 to be suspended over the sink.

Referring now to FIGS. 4A and 4B, there are shown the adjustable connector pipe in accordance with multiple embodiments of the present invention. The adjustable connector pipe 110 includes telescopic piping which allows a user to adjust the length of the adjustable connector pipe 110. The telescopic piping include a plurality of apertures adapted to receive a first butterfly clamp 122 and a second butterfly clamp 124. The adjustable connector pipe 110 further includes a lever arm 126 to secure the adjustable connector pipe 110 at a desired length. In an alternate embodiment, the adjustable connector pipe 110 may include springs disposed within the telescopic pipes. The springs are biased to an extended position and can be pushed forward to retract. The spring force of the piping allows the adjustable connector pipe 110 to accommodate sinks of varying lengths without manually adjusting the length the length of the adjustable connector pipe 110.

In an alternate embodiment, the adjustable connector 110 is fabricated by using a washing machine hose. A PVC pipe and a heavy duty washer hose can function in a telescopic manner. Clamps 122 and 124 are placed along the length of the hose to secure the adjustable connector 110 in place. This alternative embodiment does not require the use of a lever clamp.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sink plunging apparatus, comprising:

a pipe mainframe defining an enclosed area, the pipe mainframe comprising a plurality of piping having a front portion and a back portion;

a first tee disposed on the front portion and a second tee disposed on the back portion of the pipe mainframe, wherein the first and second tees are disposed outwardly from the front portion and the back portion;

an adjustable connector coupled to the back portion, the adjustable connector including telescopic connector pipes that are secured in placed via a fastener to adjust a length of the adjustable connector;

a pipe cap secured to a distal end of the first tee wherein said pipe cap is adapted to cover a run-off opening of a sink; and a cap at a distal end of the adjustable connector.

2. The apparatus of claim 1, wherein the pipe cap comprises three plastic fittings inserted within the rubber pipe cap.

3. The apparatus of claim 1, wherein the adjustable connector further comprises a first butterfly clamp defining the length of the pipe mainframe.

4. The apparatus of claim 3, wherein the adjustable connector comprises a second butterfly clamp at the base of the rubber cap.

5. The apparatus of claim 1, wherein said enclosed area is rectangular.

6. The apparatus of claim 1, wherein the enclosed area defines an aperture configured to receive a plunger.

7. The apparatus of claim 1, wherein the pipe mainframe comprises 0.5 inch plastic piping with 90° elbows defining a square aperture.

8. The apparatus of claim 1, wherein the first and second tees comprise T-shaped pipes disposed outwardly from the front portion and the back portion.

9. An apparatus for effectively plunging a sink, comprising:

a pipe mainframe defining a square-shaped area, the pipe mainframe comprising a front portion and a back portion;

a tee disposed on the front portion and the back portion of the pipe mainframe, wherein the tee is disposed outwardly from the front portion and the back portion;

an adjustable connector coupled to the back portion, the adjustable connector including telescopic connector pipes that are secured in placed via a fastener to adjust a length of the pipe mainframe, wherein the telescopic arms include springs;

a rubber pipe cap at a distal end of the tee at the front portion of the pipe mainframe; and a rubber cap at a distal end of the adjustable connector at the back portion of the pipe mainframe.

10. The apparatus of claim 9, wherein the pipe mainframe encloses a rectangular area.

11. The apparatus of claim 9, wherein the pipe mainframe defines an aperture configured to receive a plunger therein.

12. The apparatus of claim 9, wherein the adjustable connector further includes a lever arm adapted to secure the telescopic arms.

* * * * *